United States Patent [19]

Roberts et al.

[11] 3,969,628

[45] July 13, 1976

[54] INTENSE, ENERGETIC ELECTRON BEAM ASSISTED X-RAY GENERATOR

[75] Inventors: Thomas G. Roberts; Romas A. Shatas; Harry C. Meyer, III; John D. Stettler, all of Huntsville, Ala.

[73] Assignee: The United States of America as represented by the Secretary of the Army, Washington, D.C.

[22] Filed: Apr. 4, 1974

[21] Appl. No.: 457,864

[52] U.S. Cl. ..... 250/402; 250/492 R; 313/55

[51] Int. Cl.[2] ..... H01J 35/00

[58] Field of Search ..... 250/492, 493, 499, 500, 250/501, 502, 402; 313/55, 330

[56] References Cited

UNITED STATES PATENTS

| | | | |
|---|---|---|---|
| 3,526,575 | 9/1970 | Bennett | 250/500 |
| 3,746,860 | 7/1973 | Shatas | 250/493 |
| 3,748,475 | 7/1973 | Shatas | 250/502 |
| 3,766,004 | 10/1973 | Roberts | 250/502 |
| 3,864,640 | 2/1975 | Bennett | 250/500 |

*Primary Examiner*—Craig E. Church

*Attorney, Agent, or Firm*—Nathan Edelberg; Robert P. Gibson; James T. Deaton

[57] ABSTRACT

Energetic electron beam assisted x-ray generator having a plasma generator and an electron source interconnected by a sealed pinch tube and control means for the plasma generator, electron source, and said sealed pinch tube to cause the electron source to be focused on the plasma from the plasma generator and to cause the electron source to be transmitted to the plasma of the plasma generator at the appropriate time to cause a maximum amount of soft x-rays to be produced by the interaction of the outputs of the plasma generator and the electron source when said plasma has been seeded with appropriate high Z-material.

6 Claims, 2 Drawing Figures

INTENSE, ENERGETIC ELECTRON BEAM ASSISTED X-RAY GENERATOR

BACKGROUND OF THE INVENTION

Soft x-ray pulses of submicrosecond duration are needed to test materials and components of pulsed fusion reactions. Techniques presently employed to generate such pulses are (a) electron diode guns bombarding a heavy metal target, (b) underground fusion devices and (c) dense focus with high Z-material electrode tips which erode during the pulse. Electron diode guns at the required x-ray energies of fractional MeV are very inefficient because the conversion efficiency of electron beam energy into Bremsstrahlung decreases superlinearly with the decrease of electron energy for a given target anode, a fact which is well known to the designers of flash x-ray tubes. In addition, at low electron energies of fractional MeV, the space charge of electron beam is not cancelled by relativistic effects and limits severely the maximum current density of the electron beam available at the target anode. Furthermore, the electric fields of the cathode are usually not sufficient to obtain a copious electron emission by the field effect and therefore the thermionic cathodes must be employed which intrinsically yield a much lower electron emission current density than field emitters. Present electron beam-Bremsstrahlung flash generators of minimum useful x-ray fluence therefore employ electron beams in the several MeV range. They generate x-ray flashes of spectral distribution which contains most of the photon energy in the hard x-ray spectral range. Because the x-ray penetration depth decreases superlinearly with the photon energy, the deposited x-ray energy density in test materials and components is substantially different for soft and hard x-ray flashes of identical fluence at the source. Therefore, pass-fail conclusions of tests on materials, components and devices performed with many MeV energy electron beam x-ray flash generators are not directly scalable to predict the performance under a soft x-ray flash. Underground fusion flash tests suffer from the intrinsic inability to separate by the time-of-flight method the various components of radiations and expansion waves generated during the test. Therefore, various radiation and blast wave effects cannot be readily differentiated and only the cumulative, gross effects are observed. Thus, the materials designer is handicapped in separating the individual contributions from each damaging radiation.

The plasma focus alone can also be used as a soft x-ray flash generator by altering the electrode design and configuration such as to increase the evaporation and erosion of certain portions of the electrodes. Because only the energy stored in the plasma focus can be used for soft x-ray production, the fluence of x-ray flash is limited. In addition, a full control of erosion of the electrodes cannot be achieved in this case. Therefore, the intensity and the spectral distribution of x-ray flashes varies from one firing to another.

Therefore, it is an object of this invention to overcome deficiencies and eliminate or substantially reduce problems encountered in producing soft x-rays.

Another object of this invention is to provide a x-ray generator that utilizes the interaction of an electron beam with a plasma to provide an additive effect to the plasma to cause an increase in the production of soft x-rays when the plasma has been seeded with high Z-material.

Still another object of this invention is to arrange and control the interaction of the plasma with the electron beam such that the electron beam energy is focused onto the very small volume of dense hot plasma of the plasma generator so as to obtain the additive effect.

A further object of this invention is to focus the electrons from the electron beam source utilizing a sealed pinch tube.

Still a further object of this invention is to affect the orbits of the electrons from the electron source as they approach the dense hot plasma by the effects from the fields of the sealed pinch tube.

SUMMARY OF THE INVENTION

In accordance with this invention, a x-ray generator is provided that includes an internal source of high energy electrons such as a modern flash x-ray machine operated in the electron beam mode, a sealed beam forming and guiding section such as a linear pinch tube device, and a plasma generator such as a coaxial plasma gun arranged and operated so that the high energy electron beam is focused onto and retained near the volume where the high density plasma is produced and has been seeded with high Z-material. The timing of the events is accomplished by using a photocontrolled means to determine when the plasma is in the desired volume and when the high energy electron beam will reach the desired volume. Thus, this x-ray generator is used to increase the production of soft x-rays from free-free transitions (Bremsstrahlung), free-bound transitions (recombination) or bound-bound transitions (line radiation), when the plasma has been seeded with a small amount of high Z (atomic number) material. The high Z atoms cause the plasma to radiate its energy away in the form of soft x-rays produced in free-free transitions, free-bound transitions, and bound-bound transitions primarily between the electrons and the high Z ions.

DESCRIPTION OF THE PREFERRED EMBODIMENT

Figure 1:
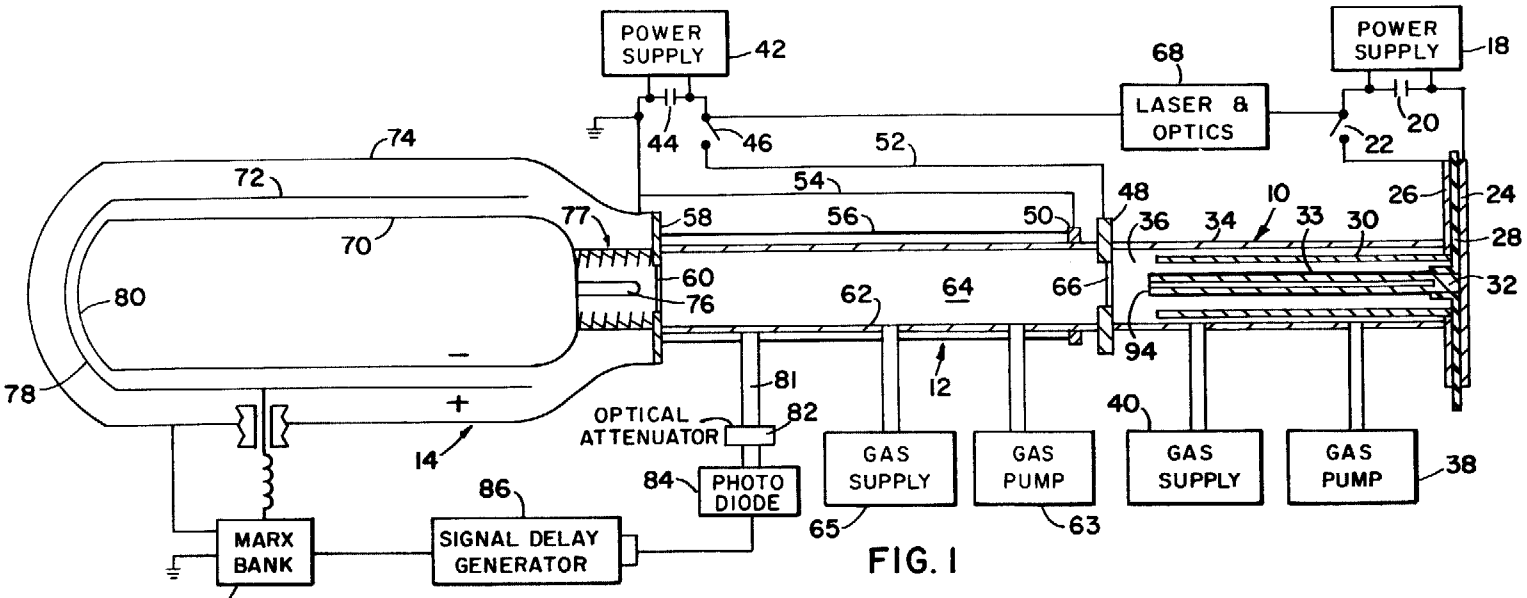
FIG. 1 is a schematic structural view of a x-ray generator according to this invention.
Figure 2:
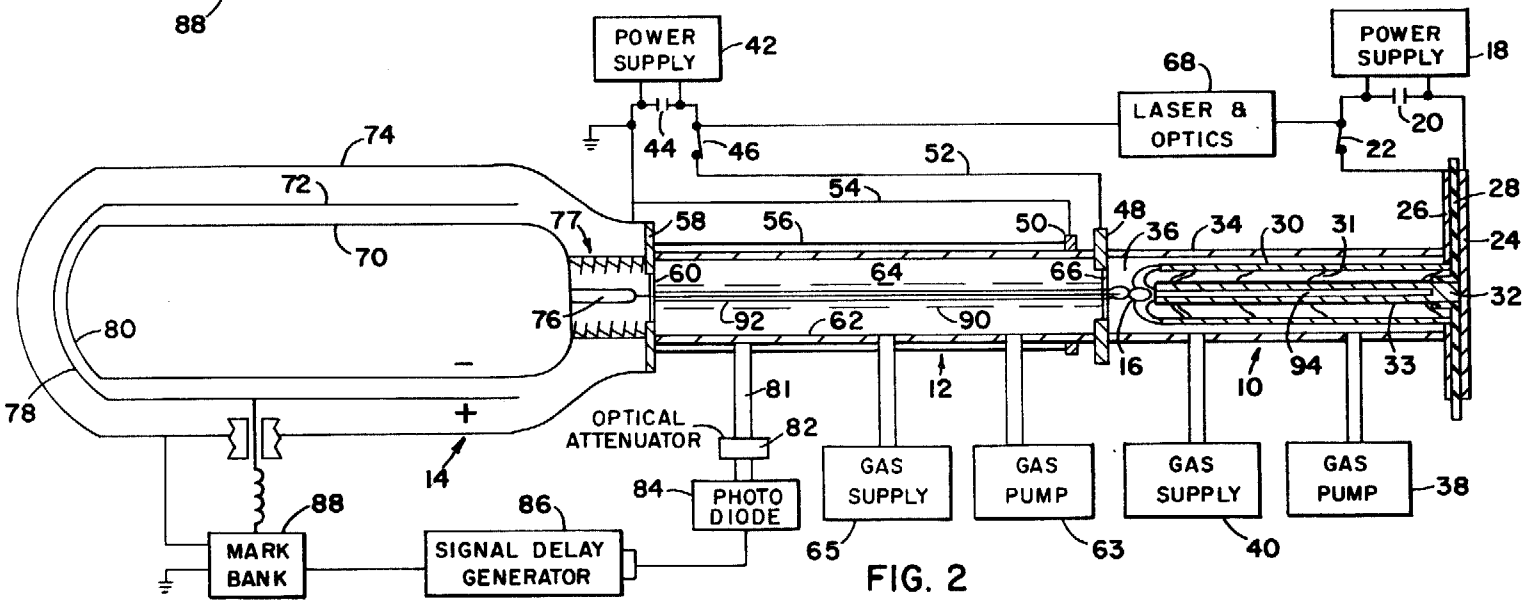
FIG. 2 is a schematic structural diagram of a x-ray generator depicted in an operating condition according to this invention.

Referring now to FIGS. 1 and 2, the apparatus according to this invention includes a plasma generator 10, a linear pinch tube device 12 and an electron beam source 14. Plasma generator 10, linear pinch tube device 12, and electron beam source 14 are axially aligned for concentrating their energies in a plasma volume 16 such as illustrated in FIG. 2. Power supply 18 is provided for plasma generator 10 and the electrical system thereof includes a condenser bank 20 and starting switch 22 that are connected to outer conductor 24 and inner conductor 26. Inner and outer conductors 24 and 26 are separated by an insulator 28. Outer conductor 24 is electrically connected to inner electrode 32 of the plasma gun portion of plasma generator 10 and inner conductor 26 is connected to outer electrode 30 of the plasma gun. An outer housing 34 generally made of glass incloses the plasma gun to form a chamber 36 therein. A gas pump 38 is connected into housing 34 for evacuating chamber 36 and gas supply 40 is connected to housing 34 for supplying gases to chamber 36.

Power supply 42 is provided for linear pinch tube device 12 and the electrical system thereof includes a condenser bank 44 and starting switch 46. Condenser bank 44 and starting swtich 46 are connected to electrodes 48 and 50 by leads 52 and 54. Electrode 50 is connected to a plurality of approximately eight wires 56 that are also connected to electrode 58. Electrode 58 has window 60 mounted therein in a conventional manner and electrode 48 has window 66 mounted therein in a conventional manner to close the ends of glass tube 62 and form chamber 64 between electrodes 48, 58, and tube 62. Windows 60 and 66 are made of conventional material for passing electrons therethrough. A gas pump 63 is connected into housing 62 for evacuating chamber 64 and gas supply 65 is connected to housing 62 for supplying gas to chamber 64. For a more detailed explanation of the structure of the conventional linear pinch tube device, consult the publication Plasma Physics, volume 10, pp. 381–389, by T. G. Roberts and W. H. Bennett.

Switch 46 of linear pinch tube device 12 and switch 22 of plasma generator 10 are coupled to conventional laser and optics device 68 for simultaneously firing plasma generator 10 and linear pinch tube device 12. Device 68 accomplishes the simultaneous firing of plasma generator 10 and linear pinch tube device 12 and the jitter is of the order of one nanosecond.

Electron source 14 consists of an internal source of high energy electrons such as a modern flash x-ray machine operated in the electron beam mode, and as illustrated includes three coaxial cylinders 70, 72, and 74. Inner cylinder 70 is connected to high voltage terminal 76 of discharge tube 77. Rounded end 78 of intermediate cylinder 72 is close to rounded end 80 of inner cylinder 70. Outer cylinder 74 forms the wall of the cylindrical tank of the electron source which is filled with oil or an insulating gas everywhere except in the discharge tube. It is to be understood that other electron producing sources other than that illustrated can be used in this invention.

Control means for electron energy source 14 include operationally connected light pipe 81, optical attenuator 82, photo-diode 84, signal delay generator 86, and Marx bank 88 that is conventionally connected to electron energy source 14 as illustrated. Marx bank 88 as illustrated contains its own power supply and the Marx bank is normally charged being in condition for discharge upon the appropriate signal from signal delay generator 86.

In operation, refer to FIG. 2. Before operation of the device is begun, plasma generator 10 and linear pinch tube device 12 are filled to the desired pressures with the gases to be used. The gas to be used in the linear pinch tube device is argon or helium, but preferrably argon and the gas to be used in the plasma generator is hydrogen or hydrogen with about a 5% molar mixture of uranium hexafluoride or other gas with high Z-material. If a hydrogen gas alone is used, inner electrode 32 is coated with a heavy metal high Z-material 33 such as copper, tungsten, titanium, zirconium, etc. High Z-material 33 on inner electrode 32 is radiated into the hydrogen atmosphere in chamber 36 as current sheath 31 moves down electrodes 28, 30 to cause plasma 16 to be seeded.

As illustrated, power supplies 18 and 42 have charged their respective condenser banks 20 and 44.

The device is now ready for operation by causing laser and optics 68 to simultaneously close starting switches 22 and 46. The closing of switch 22 causes the voltage of condenser bank 20 to appear across the electrodes of the coaxial dense plasma focus gun and the gas in the coaxial plasma generator breaks down near insulator 28 forming current sheath 31. Current sheath 31 then propagates between the outer electrode 30 and inner electrode 32 and is driven by the magnetic pressure of its own magnetic field. The discharge becomes more intense as the sheath propagates. When current sheath 31 reaches the end of electrodes 30 and 32, it folds back on itself and rapidly collapses the plasma toward the axis of plasma generator 10 as in a Z-pinch. This produces hot plasma volume 16 where electron or ion number density may be as high as $10^{19}$ $cm^{-3}$, the temperature may be as high as several times $10^{7°}$ Kelvin and the confining magnetic fields of the order of megagauss. At this time and for a period of the order of a microsecond, x-rays are produced. The velocity of the propagation of current sheath 31 and therefore the time of collapse of the plasma toward the axis is a function of the voltage on condenser bank 20.

During the same time period, the voltage of condenser bank 44 due to the simultaneous closing of switches 22 and 46, has appeared across electrodes 48 and 58 of linear pinch device 12. The gas in linear pinch device 12 breaks down along the glass wall of enclosure 62 between electrodes 48 and 58. Current sheath 90 then leaves the wall of tube 62 and moves radially inward toward the axis of linear pinch device 12. The velocity with which this current sheath approaches the axis of the linear pinch device is a function of the voltage on condenser bank 44. As current sheath 90 moves toward the axis of linear pinch device 12, the light produced increases in intensity and the light is detected by light pipe 81 which carries the detected light to photodiode 84 after having passed through optical attenuator 82. Optical attenuator 82 is preset so that accidental changes in the light intensity will not cause signal delay generator 86 to begin to operate until current sheath 90 has reached a predetermined location along the radius of linear pinch device 12. Light pipe 81 and photo-diode 84 are used partially to insure that noise does not start signal delay generator 86 to function too soon. The signal which starts signal delay generator 86 is delayed a preset amount and is then used to erect Marx bank 88 of electron source 14 to cause high energy electrons to enter linear pinch tube device 12 through thin window 60 from electrode 76. Once the high energy electrons find themselves in the medium of linear pinch tube device 12, their space charge is neutralized and they form a relativistic pinched beam 92 which is guided by the magnetic field of linear pinch tube device 12 to electrode 48 which has window 66. When the beam of high energy electrons pass through window 66, they tend to diverge but before the beam expands much it is in the presence of the high magnetic fields of dense plasma 16. The high magnetic fields of the dense plasma are arranged so that the high energy electrons are again focused onto the volume which contains the high temperature, high density plasma. The energy delivered to the plasma will tend to raise the temperature of the plasma, but instead nearly all of the added energy from the electron source will be radiated away in the form of x-rays.

In order to operate the x-ray generator again, one must recharge condenser banks 22, 44 and Marx bank 88. It may also be necessary from time to time to replace window 66, but having the end of electrode 32 open as illustrated at 94 will reduce the frequency with which this must be done.

In the production of x-rays, it is not necessary to keep the plasma in plasma generator 10 clean, but window 66 is used to separate the gas in linear pinch tube device 12 from the gas or gases in plasma generator 10. Linear pinch device 12 uses a gas atmosphere which is free of high Z material to pick up and form the intense high energy electron beam. The magnetic field configuration of this invention is such that the beam is transmitted by the linear pinch tube device to the hot plasma that has been seeded by high Z material to cause greater numbers of x-rays to be produced.

We claim:

1. An electron beam assisted x-ray generator comprising a plasma generator; a source of high energy electrons; and a sealed beam forming and guiding section interconnecting said source of high energy electrons and said plasma generator; and control means for the plasma generator, the sealed beam forming and guiding section, and the source of high energy electrons, said plasma generator having a chamber therein that is filled with a gas including hydrogen and said gas being subjected to high Z material in said plasma generator chamber to cause x-rays to be produced from the interaction of a hot plasma produced by the plasma generator and electrons from said source of high energy electrons, said beam forming and guiding section being a sealed linear pinch tube device and said control means for said beam forming and guiding section and said plasma generator including a chargeable capacitor bank for each of said beam forming and guiding section and said plasma generator, and control means for simultaneously firing each said capacitor bank to cause said plasma generator to produce a plasma and said sealed linear pinch tube device to produce a current sheath for guiding electrons from said source of high energy electrons to said hot plasma, said control means for said source of high energy electrons including means responsive to the current sheath produced in said sealed linear pinch tube device to cause said source of high energy electrons to be emitted in reponse to a predetermined current sheath condition being established, and said sealed linear pinch tube device being filled with a gas selected from argon and helium.

2. An electron beam assisted x-ray generator as set forth in claim 1, wherein said plasma generator includes an inner electrode that has a bore therein.

3. An electron beam assisted x-ray generator as set forth in claim 1, wherein said high Z material is selected from the group consisting of copper, tungsten, titanium and zirconium and wherein said plasma generator includes an inner electrode and said high Z material is on the outer surface of said inner electrode.

4. An electron beam assisted x-ray generator as set forth in claim 3, wherein said gas filling said linear pinch tube device is argon.

5. An electron beam assisted x-ray generator as set forth in claim 1, wherein said high Z material is uranium hexafluoride and is present in an amount of about 5 percent molar fraction of said gas filling said chamber of said plasma generator.

6. An electron beam assisted x-ray generator as set forth in claim 5, wherein said gas filling said sealed linear pinch tube device is argon.

* * * * *